US005544468A

United States Patent [19]

Harrison et al.

[11] Patent Number: 5,544,468

[45] Date of Patent: Aug. 13, 1996

[54] PORTABLE SHIPPING STATION

[75] Inventors: Lewis I. Harrison; Marjorie S. Harrison, both of Boulder, Colo.

[73] Assignee: Preferred Packaging Systems, Inc., Boulder, Colo.

[21] Appl. No.: 292,086

[22] Filed: Aug. 17, 1994

[51] Int. Cl.[6] ..... B65B 67/00

[52] U.S. Cl. ..... 53/390; 53/136.3; 53/238; 53/474

[58] Field of Search ..... 53/390, 136.3, 53/136.1, 238, 474, 284.5, 476; 248/98, 328, 329; 242/557

[56] References Cited

U.S. PATENT DOCUMENTS

| | | | |
|---|---|---|---|
| 2,932,139 | 4/1960 | Leslie | 53/390 |
| 3,579,962 | 9/1969 | Mitten | 53/390 |
| 3,648,433 | 3/1972 | Owen | 53/390 |
| 3,667,593 | 6/1972 | Pendleton | 53/472 |
| 3,691,727 | 9/1972 | Doerscheln | 53/390 |
| 3,907,627 | 9/1975 | Treiber | 53/390 |
| 4,018,034 | 4/1977 | Keren | 53/390 |
| 4,546,598 | 10/1985 | Karpisek | 53/390 |
| 4,619,104 | 10/1986 | Germunson | 53/390 |
| 4,922,687 | 5/1990 | Chow et al. | 53/238 |
| 5,188,308 | 2/1993 | Tussing | 242/557 |
| 5,275,349 | 1/1994 | Tussing | 242/557 |

OTHER PUBLICATIONS

Packaging Magazine, May 1992.

*Primary Examiner*—John Sipos
*Assistant Examiner*—Ed Tolan
*Attorney, Agent, or Firm*—Duft, Graziano & Forest, P.C.

[57] ABSTRACT

A portable shipping station (20) includes a wheeled cart assembly (22), a central table (24), a packaging dispenser roller support frame (26), and a pivotable hopper boom assembly (28). The roller support frame (26) serves to dispense packaging materials (122, 124) from a detachable rod (120) that may be retained at selected elevations by hooks (e.g., 116, 118) on a pair of upright standards 108, 110). A boom (140) may be used to pivot a filler-dispensing hopper assembly (158) along a horizontal arc (148).

29 Claims, 5 Drawing Sheets

PORTABLE SHIPPING STATION

BACKGROUND OF THE INVENTION

1. Field of the Invention

The present invention pertains to the field of packaging equipment and, more particularly, to portable structures that may be used to facilitate the packaging of articles for shipment. Still more particularly, the portable structure includes a wheeled cart providing a compact, organized shipping station capable of rapidly dispensing a variety of packaging materials at various points of use.

2. Statement of the Problem

An essential activity in the shipping or transportation of many goods is the precaution of packaging these goods to protect them from damage during transport. Warehouse space that is dedicated to a traditional "shipping department" often serves to fulfil this need; however, a dedicated shipping department consumes space that cannot also be used to hold inventory or conduct other operations. Accordingly, the small dimensions of many such departments induce major trouble upon minor deviations from the routine. For example, the requirement of repackaging improperly packed goods or adjusting shipment contents after their initial packaging can correspondingly induce confusion, lost shipment orders, and significant delays in throughput.

The past two decades or so have witnessed the development and widespread application of greatly improved packaging materials. These materials include commercially available foam wrap, bubble wrap, styrofoam filler materials, polyester films, and other plastic products. The exceptional strength and shock-adsorption capabilities of these new materials have substantially changed packaging techniques. Devices that were once used to dispense such packaging materials as brown wrapping paper and string are now typically obsolete.

Mitten, U.S. Pat. No. 3,579,962, discloses a combined wrapping and taping work table for shipping department use. The rectangular table is mounted upon four small caster wheels, and provides a number of interior chambers that may be used to retain various label dispensers and upright rolls of packaging paper. The top portion of the work table presents a single, flat working surface formed of a fixed lid member covering the large paper rolls, and a hinged lid member that provides access to the label dispensers. The upright rolls of paper are each controlled through a paper dispensing stand including a base, an upright standard or pole received within an open center of the rolled paper, and a spring-pressed brake arm for preventing excessive unrolling of paper. Rolled paper is obtained from beneath the table in an action that requires the operator to stoop for that purpose.

The device of the Mitten patent is mounted upon four small casters that provide for poor overall mobility of the device. The casters provide four independent pivot points that induce poor steerability. Additionally, casters of this type typically exhibit poor durability under heavy loads. The wrapping paper, which is positioned beneath the table top, is difficult to access. Furthermore, aside from the working surface, the device has no storage for either packed or unpacked boxes, and the device is unable to dispense bulky modern packaging materials. Accordingly, the device is not truly mobile in the sense of providing a vehicle for the rapid deployment of modern packaging materials to various points of use.

There remains a heartfelt need for the development of an organizer and dispenser of modern packaging materials to provide a truly self-contained, rugged, portable, and compact station.

SOLUTION TO THE PROBLEM

The present invention overcomes the problems that are outlined above by providing a fully functional portable shipping station, i.e., a shipping department on wheels. The shipping station provides everything an operator needs to conduct packaging operations at point of use sites throughout a shipping or manufacturing facility.

Broadly speaking, the shipping station includes a work table and a packaging material dispenser mounted upon a cart. The cart has a deck that is operably coupled with a plurality of downwardly extending wheels for rolling the station from a first ground location to a second ground location. The work table has a top presenting an uppermost working surface and a top-supporting frame rising from the cart to the table top. The packaging material dispenser preferably includes an adjustable frame, which serves to dispense rolled packaging materials for use at the table working surface from a plurality of selected elevations above the table working surface.

Preferred embodiments of the present invention may include a cart-based hopper assembly for dispensing bulk particulate packaging filler material. The preferred hopper assembly includes a rope and pulley system for supporting a hopper at selected elevations over the cart deck. The hopper is preferably mounted upon the cart through the use of a pivot having a vertically oriented pivot axis. The pivot is connected to a boom that extends outwardly from the pivot axis over a distance sufficient to place the hopper at selected positions along a horizontal arc traveling across the cart deck and/or the table working surface.

Especially preferred embodiments include the cart having an operator's steering handle rising from the deck at a location proximal to a first end of the deck. The deck is elongated along a line drawn between the first end and a second end remote from the first end. The table is affixed in a central deck position intermediate a collapsed-box carrying bay proximal to the first end and a filled-box carrying bay proximal to the second end. The cart wheels preferably include at least two caster wheels each pivotable with respect to the deck around a substantially vertical axis, and two fixed wheels. Each of the caster wheels are connected to the deck at respective first positions equidistant from the first end and proximal to the first end. Each of the fixed wheels are connected to the deck at respective second positions equidistant from the first end and remote from the first end of the cart. Additionally, each of the caster wheels and the fixed wheels preferably have a diameter exceeding at least about six inches, and more preferably exceeding about eight inches to provide the cart with significantly enhanced levels of durability and mobility.

The table top preferably includes a reversible lowermost working surface remote from the uppermost working surface. The top-supporting frame then preferably includes a top-receiving cavity that is used for disconnecting the top from the top-supporting frame and for reconnecting the top thereto in an inverted position with the lowermost working surface substituted in place of the uppermost working surface.

The packaging material dispenser preferably includes a roller support frame carrying a plurality of opposed hook pairs, with each hook having an open upper end. The hooks are mounted upon the support frame at equal respective distances above the table uppermost working surface. A horizontally extending primary rod has opposed first and second primary rod ends, which are correspondingly received within the first and second hooks of a first selected hook pair. The primary rod is designed to hold multiple rolls of packaging materials, such as a roll of bubble wrap and a roll of foam wrap each having a central axial opening receiving the primary rod for rotation of the axial opening around a horizontal axis of elongation in the primary rod. The roller support frame may also be provided with a secondary rod having first and second opposed secondary rod ends received within a second selected pair of hooks. The secondary rod may serve to retain a roll of adhesive labels at an elevation above the table working surface.

Especially preferred embodiments include the table being provided with a plurality of compartments for receiving packaging materials. These compartments may include at least one horizontal shelf beneath the uppermost working surface, where stacked collapsed boxes may be held until needed for use. The compartments may also include a horizontal row of open-ended boxes positioned atop the uppermost working surface. The respective boxes have dimensions that are defined by a corresponding vertical wall slidably received within a selected pair of opposed groves. The boxes can also have a common rear wall formed of pegboard that is capable of receiving hooks for hanging items from the rear wall. The compartments may also include a lock-box positioned adjacent to the horizontal row of boxes for the storage of valuables or expensive packaging materials. The lock box may contain an interior partition wall and an external slot for use in dispensing valuable adhesive labels.

Numerous other features, objects and advantages of the invention will become apparent from the following description when read in conjunction with the accompanying drawings.

DETAILED DESCRIPTION OF THE PREFERRED EMBODIMENTS

Figure 1:
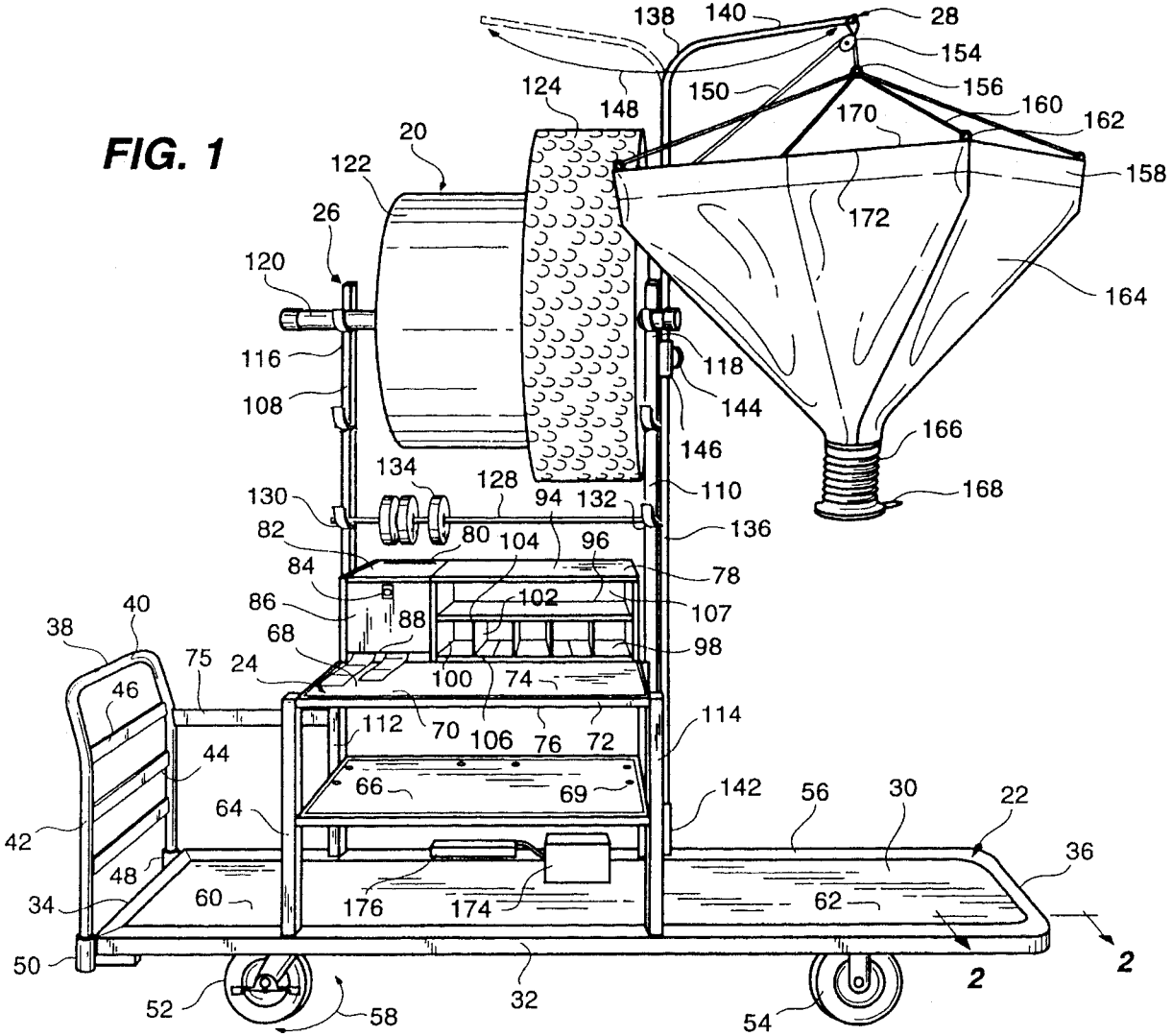
FIG. 1 depicts a front elevational perspective view of a shipping station according to a first embodiment of the present invention having a cart-mounted table, a rearward roller support frame, and a hopper and boom assembly.

FIG. 1 depicts shipping station 20, which provides a compact, rugged, mobile, and organized center for the conduct of packaging operations. Station 20 is formed of various subassemblies including rectangular cart 22, central table 24, packaging dispenser roller support frame 26, and pivotable hopper boom assembly 28.

Figure 2:
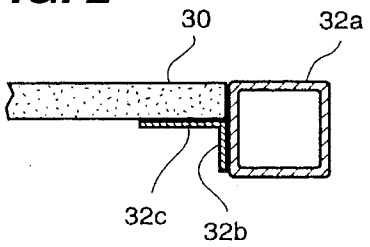
FIG. 2 depicts a sectional view taken along line 2'—2' of FIG. 1.

FIGS. 1 and 2 best depict cart 22 including rectangular deck 30, which is formed of a pressed particle board material that is laminated with plastic on its upper and lower faces. Deck 30 has an outer perimeter surrounded by a robust rectangular frame 32. Frame 32 (see FIG. 2) is formed of a two-inch square steel tube **32*a*, which is welded to angle iron 32*b* presenting an inwardly extending horizontal lower lip 32*c* for the support of deck 30. Frame 32 extends between first end 34 and second end 36, with corners at each end being defined by appropriate three to five-inch radius 90° bends at end 36 or 90° welds at end 34. Tubular operator's steering handle 38 has a concave-down bow shape including an outwardly offset uppermost gripping portion 40 connecting opposed legs 42 and 44, as well as a plurality of central reinforcing slats, e.g., slat 46, connecting legs 42 and 44. Handle 38 is mounted upon frame 32 by the provision of opposed cylindrical connectors 48 and 50, which are correspondingly sized to receive the lower ends of legs 42 and 44. Connectors 48 and 50 are welded to frame 32 at respective positions proximal to first end 34. Deck 30 is supported by a plurality of wheels including a first pair of lockable caster wheels, e.g., caster wheel 52, and a second pair of fixed wheels, e.g., wheel 54**.

Each of wheels 52 and 34 has an identical mate that is mounted on the opposed rearward side 56 and spaced equidistantly from first end 34. Wheel 52 preferably has a conventional caster mounting (not depicted) forming its connection with deck 30. As depicted in FIG. 1, wheel 52 is facing to roll forward, but the caster mounting includes a pivot connection permitting a 360° freedom of rotation about a vertical axis to enable wheel 52 to face any direction along wheel pivot arc 58 in the manner of a conventional caster wheel. In contrast, fixed wheel 54 can only roll forward as depicted in FIG. 1, and cannot pivot with respect to deck 30. Wheel 34 is attached to frame 30 at a position remote from first end 34.

Table 24 divides deck 30 into a collapsed-box-carrying bay 60 and a filled-box-carrying bay 62. Table 24 includes four legs, e.g., leg, 64, rising vertically from horizontal frame 32 to support interior-compartmental shelf 66 and table top 68. Shelf 66 and top 68 are preferably identical with one another, and have interchangeable components. Shelf 66 includes six holes, e.g., hole 69, that are positioned identically in comparison with respect to six holes in top 68. Top 68 is formed of a central rectangular planar member 70, which is formed of pressed particle board having the upper and lower surfaces laminated with plastic. Member 70 is surrounded at its outer perimeter by a horizontal rectangular top-supporting frame 72 formed of centrally-facing 90° angle iron providing an interior cavity correspondingly sized to receive member 70. Frame 72 serves to support member 70 against gravitational forces. The uppermost working surface 74 on member 70 provides a plastic cutting surface that permits cutting without excessively dulling a knife blade. Member 70 also has a lower working surface 76, identical to surface 74, which can be inverted in place of surface 74. Horizontal reinforcing bar 75 connects handle leg 44 with table 24 for mutual support, and forms a rearward barrier to bay 60.

Figure 5:
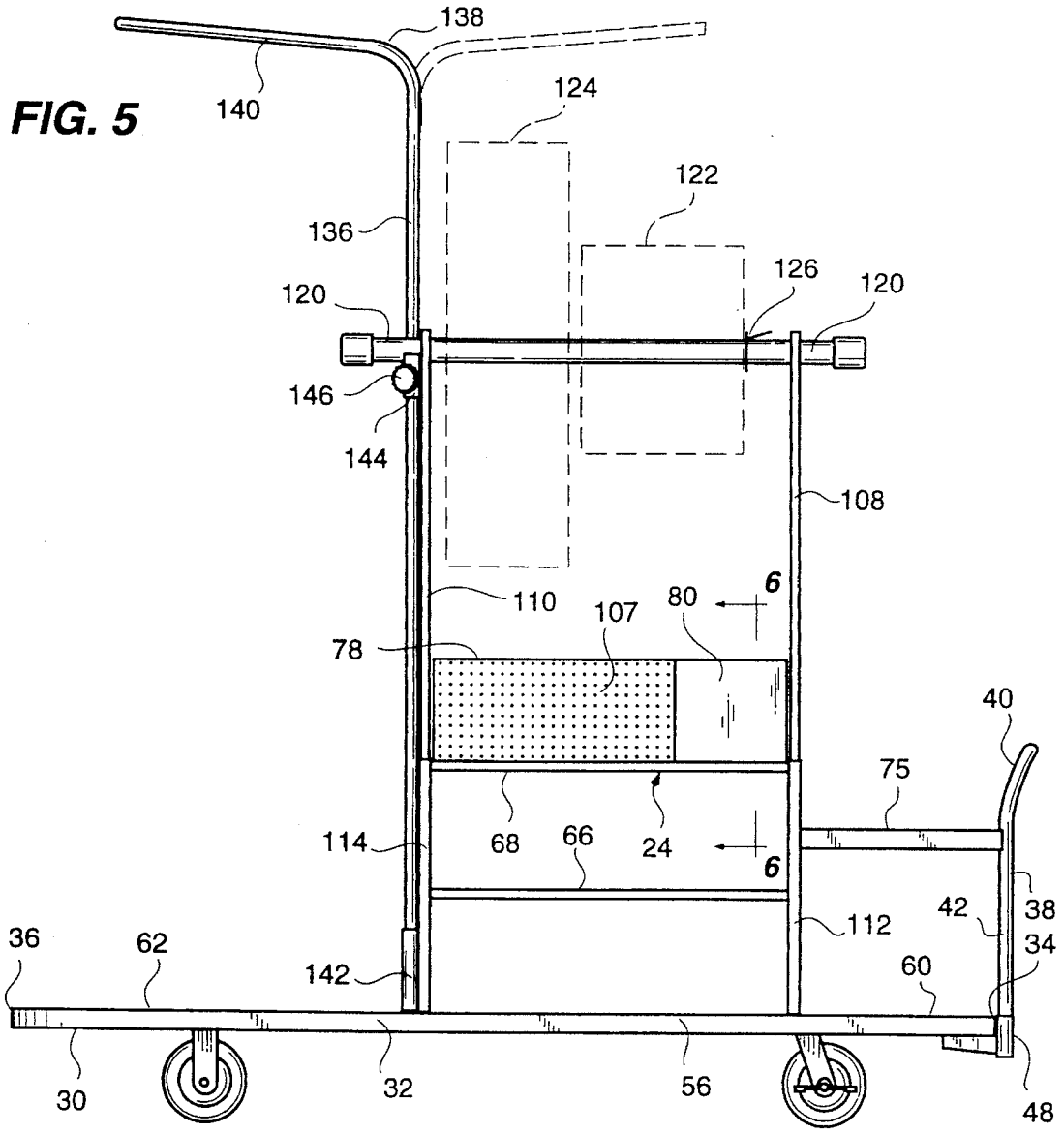
FIG. 5 depicts a rear elevational view of the FIG. 1 embodiment.
Figure 6:
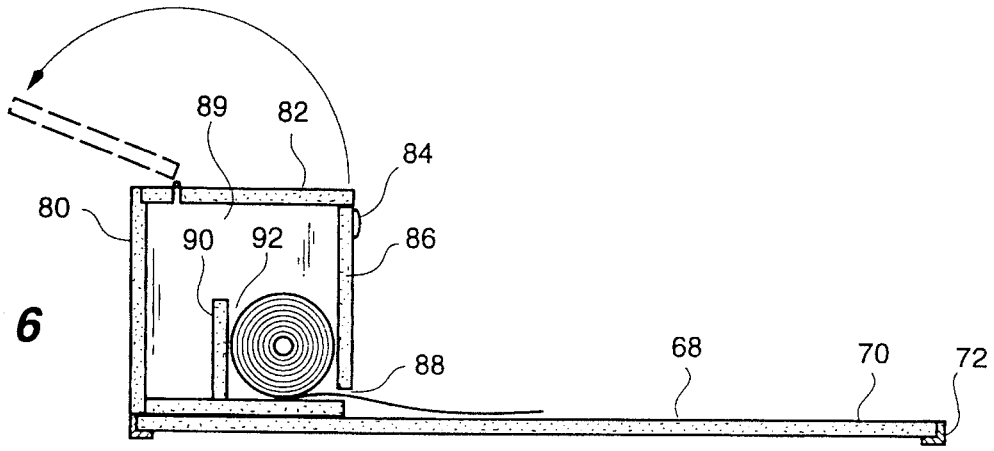
FIG. 6 depicts a right-hand side sectional view of the FIG. 1 embodiment, as taken along line 5'—5' of FIG. 4.

FIGS. 1, 5 and 6 best depict compartmental assembly 78, which rests atop surface 74 and is affixed thereto by several wood screws (not depicted) passing through member 70. Assembly 78 includes a lockbox 80, which is glued and screwed together for strength. Lockbox 80 has a rearwardly hinged lid 82 and a forward lid lock 84 that is received in front wall 86 with a conventional complimentary lock-engaging portion retained in lid 82. Wall 86 also includes a horizontal through slot 68. As depicted in FIG. 6, lockbox 80 has marginal wall structure providing an interior chamber 89 and an interior vertically rising partition wall 90 forming a five-sided roll-receiving compartment 92 within chamber 89 for dispensing rolled adhesive labeling materials through slot 88. FIG. 1 depicts assembly 78 having shelf members 94, 96, and 98. A plurality of boxes, e.g., box 100 are formed between middle shelf 96 and lower shelf 98 with lateral dimensions being defined by slidable vertical side walls, e.g., side wall 102. Each wall, e.g., wall 102, is slidably received within a pair of opposed grooves, e.g., grooves 104 and 106, which are cut into respective shelves 96 and 98. Accordingly, the lateral dimensions of box 100 can be increased by sliding wall 102 forward for removal. Box 100 has a common rear wall 107 with the other boxes of assembly 78. Wall 107 is formed of pegboard for receiving conventional pegboard hooks and clips to hang various items therefrom as needed.

FIGS. 1 and 5 best depict roller support frame 26. Frame 26 is formed of two identical upright standards 108 and 110, which are made of angle-iron received within complimentary square tubes 112 and 114 for lateral support. Tubes 112 and 114 rise from frame 32, and, in turn, find their support from welds to the respective legs of table 24. As depicted in FIG. 1, standards 108 and 110 have multiple pairs of equal-sized, concave-up hooks, i.e., hooks 116 and 118, which detachably receive opposed ends of horizontal primary rod 120 at equal elevations above uppermost working surface 74. Rod 120 passes through the respective centers of rolled foam wrap 122 and rolled bubble wrap 124, which are retained by spring clamp 126 (see FIG. 5). Rolls 122 and 124 may optionally be separated from contact with each other by a central flattened wooden disk (not depicted), which is likewise retained upon rod 120 between rolls 122 and 124. A secondary rod 128 is similarly received in a second pair of upwardly open hooks, i.e., hooks 130 and 132, for dispensing rolled adhesive labeling materials 134.

Figure 3:
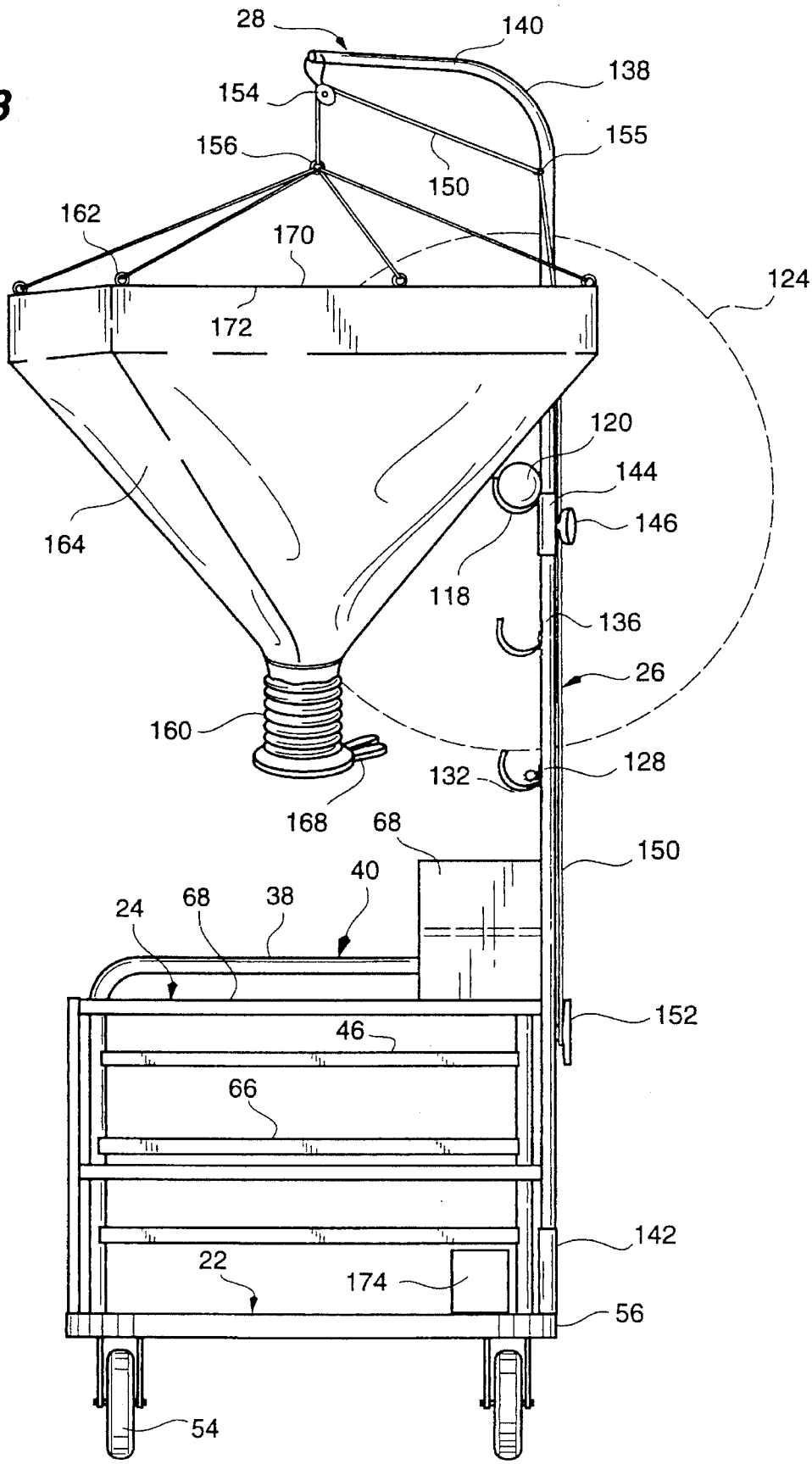
FIG. 3 depicts a left-hand side elevational view of the FIG. 1 embodiment.
Figure 4:
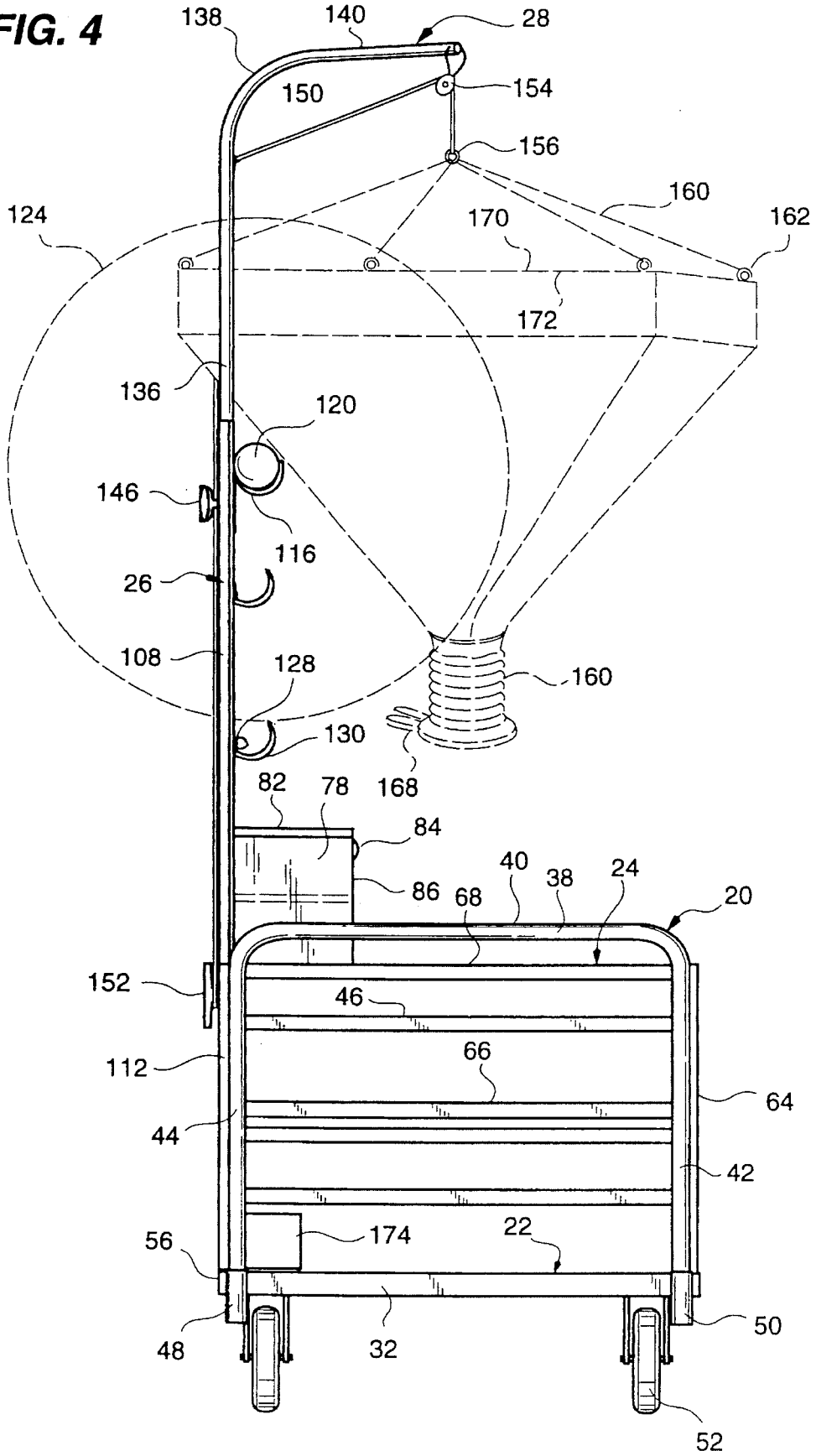
FIG. 4 depicts a right-hand side elevational view of the FIG. 1 embodiment.
Figure 7:
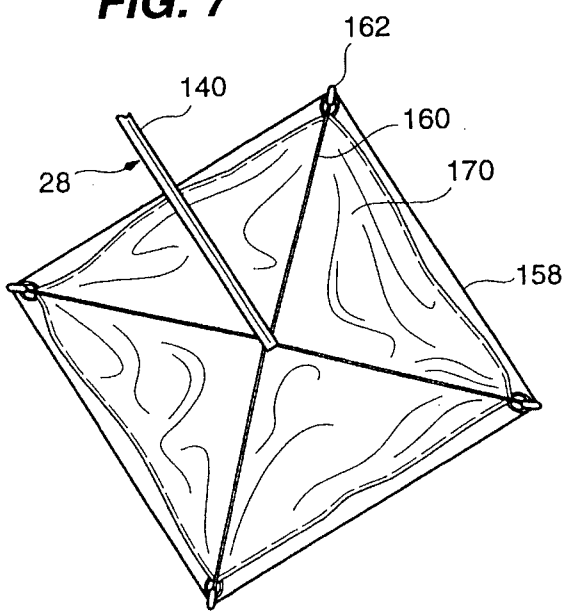
FIG. 7 depicts top plan view of the hopper assembly having a cover attached to prevent wind from scattering the hopper contents.

FIGS. 1 and 3 best depict hopper boom assembly 28. Assembly 28 includes an upright pivotal rod segment 136, which is bent at angle 138 to form an outwardly-extending upper boom portion 140. Lower cylinder 142 is welded to tube 114, and concentrically receives rod segment 136 to form a pivot. Upper cylinder 144 similarly receives rod segment 136, but is also provided with a threaded locking screw 146, as needed, to prevent rotation of boom 140 along horizontal boom arc 148 by frictionally engaging segment 136. Cable 150 is preferably formed of a wire rope or fiber rope, and is anchored at cleat 152. Cable 150 has passes through pulley 154 at the end of boom 140, through eyelet 155 on pivot member 136, and has an end 156 which is tied to hopper assembly 158. Hopper assembly 158 is a modified version of a hopper that may be purchased on commercial order from Storopack of Downey, Calif., and includes several corner guy wires, e.g., wire 160, leading from cable end 156 to corresponding eyelets, e.g., eyelet 162, at respective corners of an interior upper metal frame (not depicted) received within an inverted pyramid 164 formed of a plastic fabric tapering downwardly to a corrugated rubber dispenser tube 166 and a lowermost flow-controlling dispenser handle 168. The commercially available hopper is modified to contain a square fabric top cover 170 that is provided with corner clips, e.g., clip 172 for attaching to eyelet 162, as depicted from the top in FIG. 7.

Cart 22 is preferably provided with a 12 V marine battery 174, which is operably connected to an electrical outlet 176. In turn, outlet 176 serves to provide power to electrical devices that may be positioned upon surface 74, such as battery operated electric scales or postage meters.

In use, shipping station 20 is transported to point of use sites throughout a shipping facility. It is significant that the large eight inch diameter wheels provide tremendous mobility throughout such facilities, due to the increased ground clearance providing an enhanced ability to roll over floor surface relief features. The larger wheels also provide greater durability in supporting heavy loads, as well as increased longevity of use as compared to the smaller caster wheels of the Mitten table. Multiple sizes of flattened or collapsed boxes (not depicted) are stored within collapsed-box-bay 60 and atop shelf 66. Packaging operations typically proceed from the first end 34 towards the second end 36 as the boxes are removed from bay 60, opened, filled with foam or bubble-wrapped goods atop uppermost working surface 74, further filled with foam peanut materials from pivotable hopper assembly 158, sealed, labeled and placed in the filled-box-carrying bay 62.

Hopper top cover 170 serves to prevent the packaging filler material within hopper assembly 158 from being blown by winds throughout the shipping or warehouse facility. Hopper assembly 158 may be pivoted to any selected position along arc 148. Accordingly, assembly 158 may be easily swung outwardly to remove it from interference with wrapping operations atop surface 74 or pivoted outwardly over bay 62 for the filling of large boxes. The length of cable 150 may be adjusted at cleat 152 to position hopper assembly at selected elevations for ease of use.

Wrapping operations atop surface 74 are expedited by the ready proximity of packaging materials such as foam wrap 122, bubble wrap 124, and labeling materials 134. Similarly, boxes such as box 100 serve to centralize and organize their contents, e.g., mailing labels, tape dispensers, stamps, inks, and other diverse but necessary items, which may be required for use. Lockbox 80 is available to protect valuables, such as postage stamps, prepaid overnight mailing labels, and postage meters. In the event that the operator experiences difficulty in reaching high enough to grasp packaging materials mounted upon primary rod 120, the elevation of rod 120 may be adjusted by lifting rod 120 from engagement with hooks 116 and 118, and placing it in a lower set of hooks.

In the event that uppermost working surface 74 becomes excessively worn by virtue of constant cutting thereon, assembly 78 may be detached by removing the screws attaching it to sheet 70, and section 70 may be inverted to provide a new working surface 76.

Figure 8:
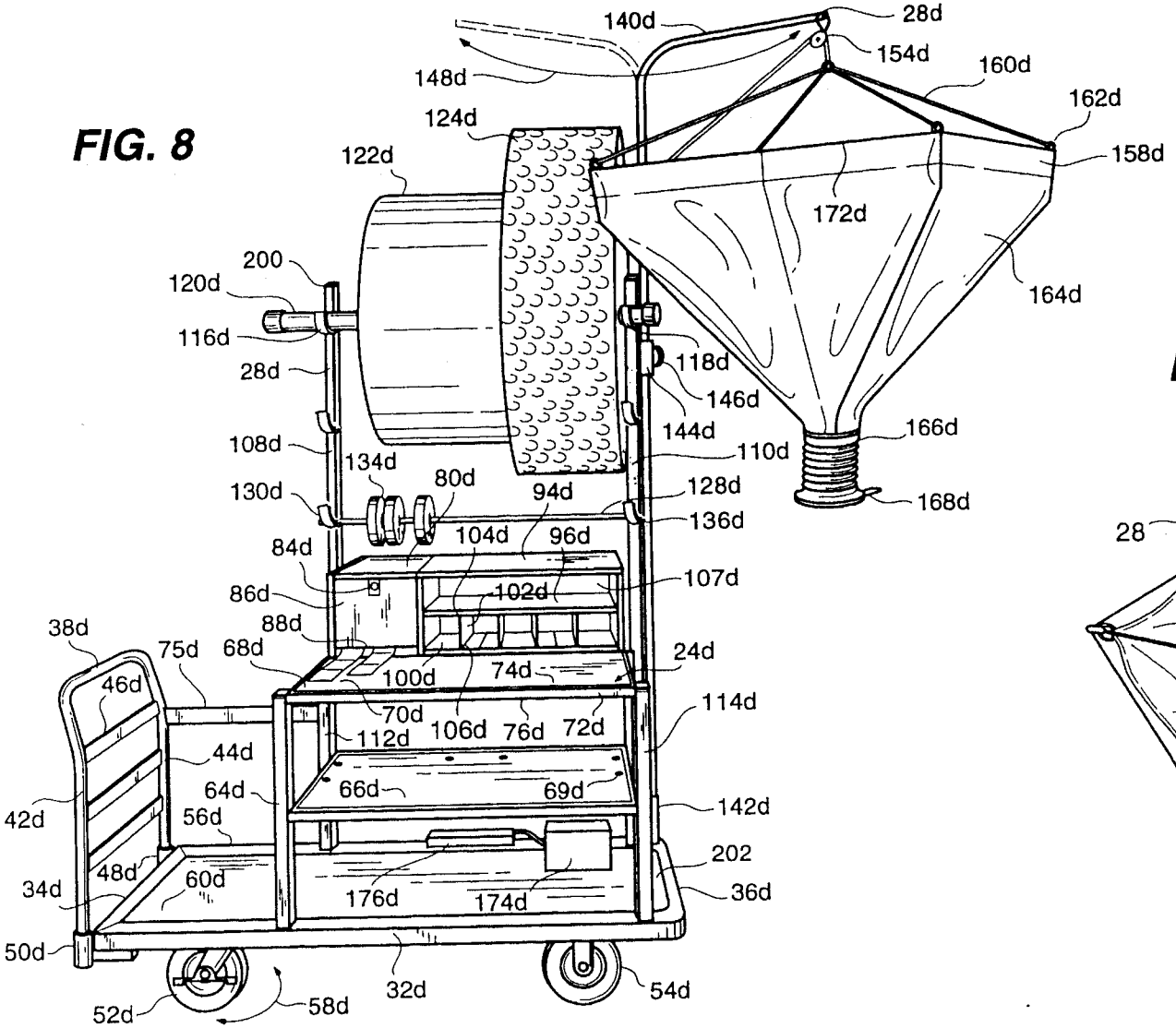
FIG. 8 depicts a second embodiment of the present invention, which has a shortened cart deck as compared to the FIG. 1 embodiment.

FIG. 8 depicts a second embodiment of the present invention, shipping station 200, wherein identical features with respect to the FIG. 1 embodiment retain like numbering followed by an additional "d" suffix. Cart 200 is identical in comparison with cart 20, except deck 202 has been shortened to remove bay 62, and wheels **52*d* and 54*d* have correspondingly been moved towards operable positions proximal to handle 38*d*. This shortened version provides greater mobility in confined areas of operation, but the increased mobility comes at the sacrifice of being able to carry packed boxes upon the former bay 62**.

Those skilled in the art will understand that the preferred embodiments, as described hereinabove, may be subjected to obvious modifications without departing from the true scope and spirit of the invention. Accordingly, the inventors hereby declare their intention to rely upon the Doctrine of Equivalents, in order to protect their full rights in the invention.

We claim:

1. A mobile shipping station for use in article-packaging operations, comprising:

a cart having a deck operably coupled with a plurality of downwardly extending wheels for rolling said station from a first ground location to a second ground location;

a work table having a top presenting an uppermost working surface and a top-supporting frame rising from said cart and operably coupled with said top to hold said top at a working elevation;

a roll-support frame rising from said table to an elevation greater than said working elevation, said roll-support frame having means for retaining a rolled wrapper material-dispensing bar at a sufficient elevation above said working surface to dispense packaging materials mounted on said dispensing bar in an essentially downward direction for use at said working surface; and a hopper for dispensing particulate packaging filler material, and means coupled with said cart for supporting said hopper over said deck, and for permitting selective adjustment in at least three degrees of freedom of a position of said hopper relative to said deck, said supporting means including a pivot having a vertically oriented pivot axis, said pivot being connected to a boom extending outwardly from said pivot axis over a distance sufficient to place said hopper at selected positions along an arc traveling across said deck, and means for hanging said hopper from said boom to permit selective adjustment of a position of said hopper relative to a position of said boom.

2. The station as set forth in claim 1, said hanging means including a pulley mounted on said boom at a position remote from said pivot, a cable having a central portion running through said pulley and a hopper end connected to said hopper, and means for anchoring said cable at selected lengths to adjust a distance between said hopper and said boom.

3. The station as set forth in claim 2, said anchoring means including a cleat attached to said top-supporting frame at a distance within reach of an end of said cable remote from said hopper end.

4. The station as set forth in claim 1, said boom having an elevation sufficient to place said hopper at selected positions along an arc traveling across said uppermost working surface.

5. The station as set forth in claim 1, further including a U-shaped operator's steering handle separate from said table and rising from said deck at a location proximal to a first end of said deck.

6. The station as set forth in claim 5, including said deck being elongated along a line drawn between said first end and a second end remote from said first end, said table being positioned in a central position intermediate a collapsed-box carrying bay proximal to said first end and a filled-box carrying bay proximal to said second end.

7. The station as set forth in claim 6, said plurality of wheels including at least two caster wheels each pivotable with respect to said deck around a substantially vertical axis and two fixed wheels, each of said caster wheels being connected to said deck side at respective first positions equidistant from said first end, and each of said fixed wheels being connected to said deck at respective second positions equidistant from said first end.

8. The station as set forth in claim 7, said first positions being proximal to said first end, said second positions being remote from said first end.

9. The station as set forth in claim 8, each of said caster wheels and said fixed wheels having a diameter exceeding at least about six inches.

10. A mobile shipping station for use in article-packaging operations, comprising:

a cart having a deck operably coupled with a plurality of downwardly extending wheels for rolling said station from a first ground location to a second ground location;

a work table having a top presenting an uppermost working surface, and a top-supporting frame rising from said cart and operably coupled with said top to hold said top at a working elevation; and a roll-support frame rising from said table to an elevation greater than said working elevation, said roll-support frame having means for retaining a rolled wrapper material-dispensing bar at a sufficient elevation above said working surface to dispense packaging materials mounted on said dispensing bar in an essentially downward direction for use at said working surface;

said top including a bottom side remote from said uppermost working surface, said top-supporting frame including means for disconnecting said top from said top-supporting frame and for reconnecting said top thereto in an inverted position with said bottom side in place of said uppermost working surface.

11. The station as set forth in claim 10, said disconnecting and reconnecting means including an upper frame member having structure defining an interior cavity sized to receive said top therein.

12. The mobile shipping station as set forth in claim 10 wherein said roll-support frame comprises a pair of upwardly elongated standards including a first standard and a second standard, said first standard having at least one concave-up first hook mounted at an equal elevation with respect to a second concave-up hook on said second standard, and a primary rod having first and second primary rod ends correspondingly received within said first and second hooks.

13. The station as set forth in claim 12, said roll-support frame further including a roll of bubble wrap and a roll of foam wrap, each of said roll of bubble wrap and said roll of foam wrap having a central axial opening receiving said primary rod for rotation of said axial opening around an axis of elongation in said primary rod.

14. The station as set forth in claim 13, said roll-support frame further including a secondary rod having first and second opposed secondary rod ends received within a second pair of hooks on said pair of standards.

15. The station as set forth in claim 14, including a roll of adhesive labels received upon said secondary rod.

16. The mobile shipping station as set forth in claim 10 wherein said table includes a plurality of compartments for receiving packaging materials.

17. The station as set forth in claim 16, said compartments including at least one horizontal shelf beneath said uppermost working surface.

18. The station as set forth in claim 16, said compartments including a horizontal row of forwardly open-ended boxes positioned atop said uppermost working surface, each of said boxes having respective dimensions defined by a corresponding vertical wall slidably received within a selected pair of opposed grooves.

19. The station as set forth in claim 18, said boxes having a common rear wall formed of pegboard capable of receiving hooks for hanging items from said rear wall.

20. The station as set forth in claim 18, including a lock-box positioned adjacent to said horizontal row of compartments.

21. The station as set forth in claim 20, said lock-box including an interior partition wall defining an interior compartment and a front wall having structure defining a forward slot for dispensing rolled adhesive labels from said interior compartment.

22. A mobile shipping station for use in article-packaging operations, comprising:

a cart having a deck operably coupled with a plurality of downwardly extending wheels for rolling said cart from a first floor location to a second floor location;

a work table having a top presenting an uppermost working surface and a top-supporting frame rising from said cart to said top; and a hopper for dispensing packaging filler material, a pivot member supported by said cart, a boom supported by said pivot, and means coupled with said boom for hanging said hopper from said boom to permit selective adjustment of a position of said hopper relative to a position of said boom.

23. The station as set forth in claim 22, said boom having a pulley mounted on said boom at a position remote from said pivot member, a cable having a central portion running through said pulley and a hopper end connected to said hopper, and means for anchoring said cable at selected lengths to adjust a distance between said hopper and said boom.

24. A mobile shipping station for use in article-packaging operations, comprising:

a cart having a deck operably coupled with a plurality of downwardly extending wheels for rolling said station from a first ground location to a second ground location, and an operator's steering handle rising from said deck at a position proximal to a first end of said deck, said deck being elongated along a line drawn between said first end and a second end remote from said first end;

a work table having a top presenting an uppermost working surface and a top-supporting frame rising from said cart to said top, said table being positioned over said deck in a position intermediate a collapsed-box carrying bay proximal to said first end and a filled-box carrying bay proximal to said second end;

a roll-support frame rising from said cart above said table, said roll support frame carrying a plurality of opposed hook pairs each having a concave up first hook and a concave up second hook mounted upon said support frame at equal distances above said uppermost working surface, and a rolled wrapper material-dispensing rod having opposed first and second rod ends correspondingly received within said first and second hooks of a first selected hook pair;

a hopper for dispensing particulate packaging filler material;

a pivot supported by said cart and having a vertically oriented pivot axis, said pivot being connected to a boom extending outwardly from said pivot axis over a distance sufficient to place said hopper at selected positions along an arc traveling across said uppermost working surface;

a cable and pulley assembly hanging said hopper from said boom; and a plurality of compartments for receiving packaging materials, said compartments including a horizontal row of compartments positioned atop said uppermost working surface, each of said compartments having respective dimensions defined by a corresponding vertical wall slidably received within a selected pair of opposed grooves, said compartments having a common rear wall formed of pegboard capable of receiving hooks for hanging items from said rear wall.

25. A mobile shipping station for use in article-packaging operations, comprising:

a cart having a deck operably coupled with a plurality of downwardly extending wheels for rolling said station from a first ground location to a second ground location;

a work table having a top presenting an uppermost working surface and a top-supporting frame rising from said cart; and means for dispensing rolled packaging materials to be used at said working surface, and for retaining said rolled packaging materials at a plurality of selected elevations above said working surface, said dispensing and retaining means being operably connected to said cart;

a hopper for dispensing particulate packaging filler material, and means coupled with said cart for supporting said hopper over said deck, said supporting means including a pivot having a vertically oriented pivot axis, said pivot being connected to a boom extending outwardly from said pivot axis over a distance sufficient to place said hopper at selected positions along an arc traveling across said deck, and means for connecting said boom with said hopper, said connecting means including a pulley mounted on said boom at a position remote from said pivot, a cable having a central portion running through said pulley and a hopper end connected to said hopper, and means for anchoring said cable at selected lengths to adjust a distance between said hopper and said boom.

26. The station as set forth in claim 25, said anchoring means including a cleat attached to said top-supporting frame at a distance within reach of an end of said cable remote from said hopper end.

27. A mobile shipping station for use in article-packaging operations, comprising:

a cart having a deck operably coupled with a plurality of downwardly extending wheels for rolling said cart from a first floor location to a second floor location;

a work table having a top presenting an uppermost working surface and a top-supporting frame rising from said cart to said top; and a hopper for dispensing packaging filler material, and means coupled with said cart for supporting said hopper above said deck, said supporting means including a pivot having a vertically oriented pivot axis, said pivot being connected to a boom extending outwardly from said pivot axis over a distance sufficient to place said hopper at selected positions along an arc traveling across said deck, and means for connecting said boom with said hopper, said connecting means including a pulley mounted on said boom at a position remote from said pivot member, a cable having a central portion running through said pulley and a hopper end connected to said hopper, and means for anchoring said cable at selected lengths to adjust a distance between said hopper and said boom.

28. A mobile shipping station for use in article-packaging operations, comprising:

a cart having a deck operably coupled with a plurality of downwardly extending wheels for rolling said station from a first ground location to a second ground location;

a work table having a top presenting an uppermost working surface and a top-supporting frame rising from said cart; and means for dispensing rolled packaging materials to be used at said working surface, and for retaining said rolled packaging materials at a plurality of selected elevations above said working surface, said dispensing and retaining means being operably connected to said cart, said top including a bottom side remote from said uppermost working surface, said top-supporting frame including means for disconnecting said top from said top-supporting frame and for reconnecting said top thereto in an inverted position with said bottom side in place of said uppermost working surface.

29. The station as set forth in claim 28, said disconnecting and reconnecting means including an upper frame member having structure defining an interior cavity sized to receive said top therein.

* * * * *